United States Patent [19]

Cutler

[11] 4,180,534

[45] Dec. 25, 1979

[54] APPARATUS FOR DISPENSING A FUEL-AIR MIXTURE IN AN AIRSTREAM

[75] Inventor: Alan B. Cutler, Missoula, Mont.

[73] Assignee: Revas, Inc., Denver, Colo.

[21] Appl. No.: 833,013

[22] Filed: Sep. 14, 1977

[51] Int. Cl.[2] ..... F02M 11/00

[52] U.S. Cl. ..... 261/41 B; 261/44 A; 261/44 D

[58] Field of Search ..... 261/48, 41 B, 44 A, 261/44 D

[56] References Cited

U.S. PATENT DOCUMENTS

| | | | |
|---|---|---|---|
| 1,103,864 | 7/1914 | Brown | 261/48 |
| 1,115,632 | 11/1914 | Weiss | 261/41 B |
| 1,152,173 | 8/1915 | Haegele | 261/41 B |
| 1,234,399 | 7/1917 | Schmid et al. | 261/48 |
| 1,392,724 | 10/1921 | Wasserlein | 261/44 D |
| 1,432,033 | 10/1922 | Peterson | 261/41 A |
| 1,740,282 | 12/1929 | Carter | 261/44 D |
| 1,983,255 | 12/1934 | Wahlmark | 261/44 D |
| 2,021,554 | 11/1935 | Jacoby et al. | 261/44 D |
| 2,313,366 | 3/1943 | Schwier | 261/41 B |
| 2,632,636 | 3/1953 | Carson | 261/41 B |
| 4,021,511 | 5/1977 | Kaufman | 261/44 A |

FOREIGN PATENT DOCUMENTS

| | | | |
|---|---|---|---|
| 538587 | 3/1912 | France | 261/44 D |
| 634802 | 2/1928 | France | 261/44 D |
| 194250 | 11/1937 | Switzerland | 261/44 D |
| 6590 | of 1913 | United Kingdom | 261/48 |

*Primary Examiner*—Tim R. Miles

*Attorney, Agent, or Firm*—Crandell & Polumbus

[57] ABSTRACT

A primary fuel-air mixture is dispersed into an airstream flowing through a venturi to achieve a desired final fuel-air mixture. The flow of air through the venturi is operatively controlled by a throttle valve means which includes a tube member having a fuel dispersing end positioned generally within a constricted portion of the venturi. Movement of the throttle tube selectively positions the fuel dispersing end in a spaced apart relationship with the constructed portion of the venturi and regulates the quantity of fuel and air flowing into an engine. The primary fuel-air mixture is supplied to a hollow interior portion of the throttle tube, and is dispersed uniformly from the fuel dispersing end of the throttle tube into the airstream. The quantity of primary fuel-air mixture dispersed is related to the quantity of air flowing through the venturi. The throttle tube is also selectively positionable to seal the fuel dispersing end with the constricted portion of the venturi, and under such circumstances a supply of idle fuel and air mixture is dispersed from the hollow interior of the throttle tube member.

8 Claims, 5 Drawing Figures

Fig-1
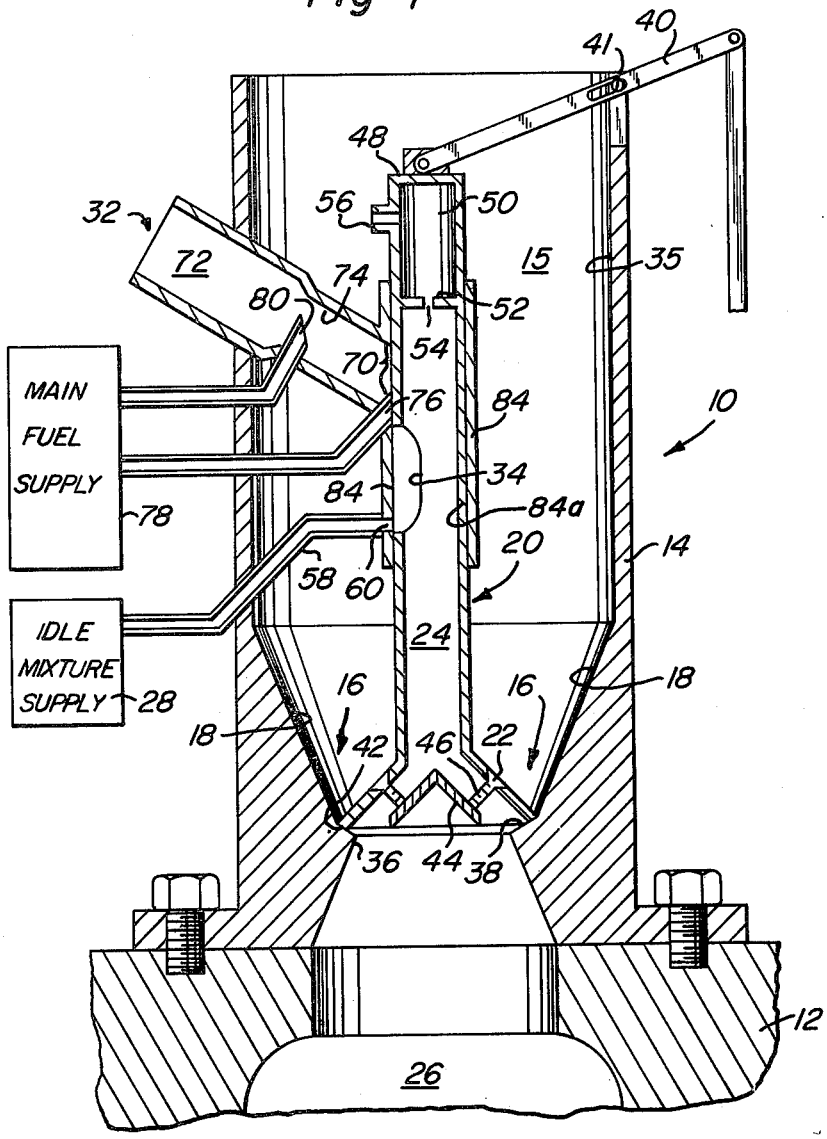
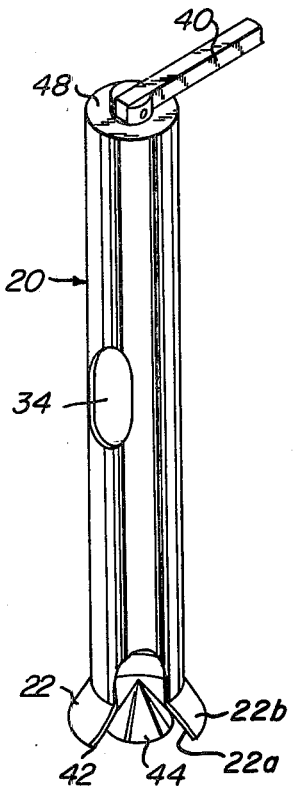
Fig-3
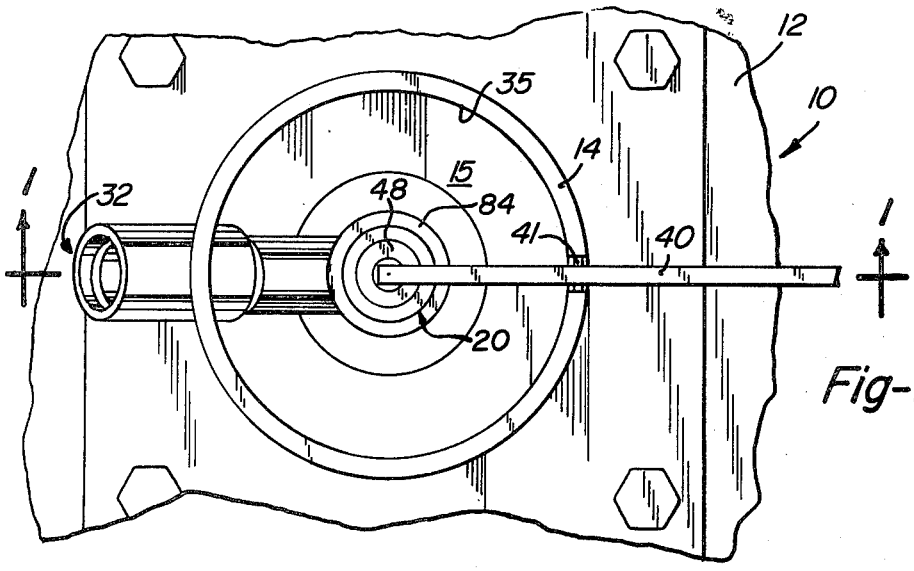
Fig-2

APPARATUS FOR DISPENSING A FUEL-AIR MIXTURE IN AN AIRSTREAM

BACKGROUND OF THE INVENTION

1. Field of the Invention

This invention generally relates to fuel delivery methods and apparatus and more particularly to an apparatus providing a variable venturi throttle and a method for dispersing a fuel-air mixture into an intake airstream for an internal combustion engine.

2. Brief Description of Prior Art

The typical carburetor is the conventional mechanism for delivering fuel to an internal combustion engine. The typical carburetor mixes a quantity of fuel from a main discharge with a quantity of air flowing through a fixed venturi, as a result of a low pressure created by the air flowing through the fixed venturi which draws the fuel into the air. A circular-shaped, butterfly valve positioned in a cylindrical throttle opening in a carburetor throttle plate controls the amount of fuel-air mixture delivered to the engine. The butterfly valve is pivoted about its diametric axis in the throttle opening to control the speed and power output of the engine. Positioned in its maximum transverse orientation across the throttle opening, very little fuel and air mixture from the fixed venturi is allowed to enter the engine. As the butterfly valve opens, crescent shaped openings are formed between the circular edges of the butterfly valve and the circular inner wall of the throttle opening to allow an increasing air flow therethrough. In its maximally opened position, the butterfly valve is aligned parallel with the axis of the throttle opening to minimally restrict the airflow therethrough.

Since the butterfly valve is essentially closed when the engine idles or runs very slowly, a supply of idle fuel is delivered directly into the engine manifold from a position downstream of the butterfly valve, with respect to the normal flow path through the carburetor, to support combustion and engine operation. However, even when the butterfly valve is open, the idle fuel is still typically supplied. Upon rapidly opening the butterfly valve, an accelerator pump injects raw fuel directly into the rapidly increasing airstream through the butterfly valve until the fixed venturi can supply sufficient fuel to support the increased engine power requirements.

Although usually reliable in operation, a number of problems with conventional carburetors have prevented attaining the best fuel consumption economy and the best reduction in pollutant emissions. These problems result in substantial measure from the construction and arrangement of the previously described elements in the typical carburetor. In controlling the amount of fuel-air mixture delivered to the engine, the butterfly valve creates significant alternations of the desired fuel-air mixture under different engine operating conditions. When the throttle valve is closed after the engine has been running at a relatively high speed, the high vacuum created by the slowing engine tends to cause a build-up or pocket of accumulated fuel at the butterfly valve, thereby significantly enriching the mixture and causing an adverse effect on pollutant emissions, particularly on hydrocarbon emissions, since the larger fuel droplets do not completely burn or combust. With the butterfly valve partially open, the fuel-air mixture flowing through the crescent shaped openings is subject to somewhat radical changes in flow stream characteristics. The flow stream changes and vacuum created at the crescent shaped opening causes the fuel droplets to accumulate around the crescent shaped openings because of the greater viscosity of the fuel compared to the viscosity of the air, thus changing the atomization characteristics or the fuel-air mixture characteristics over those characteristics obtained from the fixed venturi. The conventional supply of idle fuel also alters the mixture during increased flow conditions. When the butterfly valve is rapidly opened, the air flow velocity through the venturi increases more rapidly than its main fuel discharge, which results initially in a lean fuel-air mixture. The accelerator pump attempts to counteract the initially lean mixture by injecting a stream of raw fuel into the airstream until the main discharge can supply sufficient fuel delivery for the increased flow. However, the raw fuel injection does not thoroughly mix or atomize with the air to provide the best combustible mixture.

The mixture alterations from a lean fuel-air mixture in some situations to a rich fuel-air mixture in other situations can rapidly occur during typical engine operation, as for example in the instance of an automobile being operated in commuter stop-and-go traffic. The inability to maintain the desired fuel-air mixture by the conventional carburetor under widely varying operating characteristics makes effective control over the pollutant emissions difficult or impossible, and also causes an adverse affect on fuel consumption economy. Certain of these factors are known and appreciated as significant problems in the prior art. Other of these factors may be more fully appreciated in view of the present invention, which is directed toward overcoming these and other problems in the prior art, and which is directed toward obtaining previously unobtainable benefits in improving fuel delivery apparatus and systems, particularly those for internal combustion engines which propel automobiles.

SUMMARY OF THE INVENTION

Accordingly, it is the general objective of this invention to provide a new and improved apparatus involving a variable venturi throttle, and a new approach to dispersing a primary fuel mixture into an airstream, to obtain a final fuel-air mixture of desired characteristics, for the general purpose of improving the operation of an internal combustion engine. More specific objectives of the invention are to provide more constant fuel-air mixture ratio over a wide variety of engine operating conditions than has previously been obtained, more complete and efficient combustion of the fuel and air mixture, better fuel consumption economy, better reduction of pollutant emissions from an internal combustion engine, termination of the idle fuel and air supply in preferance to a normal fuel-air mixture supply during increased operating conditions, and elimination of the necessity for injecting raw fuel into the airstream during rapidly increasing airflow requirements.

According to the present invention, an airstream flows through a venturi, and a previously mixed or primary fuel-air mixture is dispersed into the airstream flowing through the venturi. The primary fuel-air mixture is evenly dispersed within the airstream to further mix the fuel with the air and obtain a secondary or final mixture of the desired fuel-air ratio. The venturi is defined by a constricted hollow interior portion of a main body member. A throttle tube member is positioned for selective movement within the venturi to control the quantity of air flow through the venturi by regulating the predetermined space between the venturi constricted portion and a fuel dispersing end of the throttle tube member. With the throttle tube positioned to provide a spaced apart relationship between the constricted portion of the venturi and the fuel dispersing end, the primary fuel-air mixture is supplied to a hollow interior portion of the throttle tube member and is essentially uniformly dispersed from the fuel dispersing end into the airstream flowing through the venturi, thereby achieving the final fuel-air mixture. The quantity of primary mixture is dispersed in predetermined relation to the quantity of air flowing through the space between the constricted portion of the venturi and the fuel dispersing end of the throttle tube member. With the fuel dispersing end of the throttle tube member sealed against the constricted portion of the venturi, thereby preventing the airstream from flowing therethrough, an idle fuel-air mixture is dispersed. The idle fuel-air mixture is essentially terminated with movement of the fuel dispersing end away from the constricted portion of the venturi. With movement of the throttle tube member, relatively uniform and undistorted changes in the flowstream characteristics of the airstream occur in the constricted portion of the venturi, which results in more thorough atomization or mixture of the fuel and air and in a better mixture ratio control.

A more complete understanding of the method and apparatus of the present invention may be obtained from the following brief description of the drawings and detailed description of a preferred embodiment of the invention.

BRIEF DESCRIPTION OF THE DRAWINGS

FIG. 1 is a section view taken substantially along a vertical plane through a preferred embodiment of apparatus according to the present invention, with certain portions of the apparatus illustrated schematically and with the preferred embodiment of apparatus attached to an intake manifold of an internal combustion engine. The vertical section plane of FIG. 1 is taken substantially in the plane of line 1—1 of FIG. 2. FIG. 1 also illustrates operation of the apparatus under low or limited flow conditions.

FIG. 2 is a top plan view of the apparatus of FIG. 1.

FIG. 3 is a perspective view of a throttle tube member forming an element of the apparatus of FIG. 1 of the present invention, with certain portions broken away.

DESCRIPTION OF PREFERRED EMBODIMENT

Figure 4:
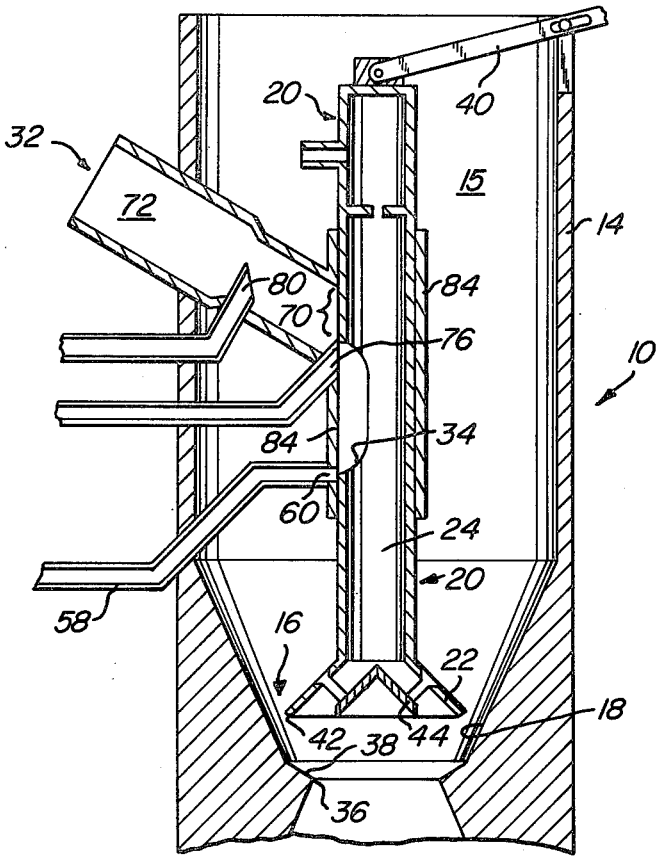
FIG. 4 is a view similar to FIG. 1 with certain elements removed for clarity which illustrates operation of the apparatus under moderate flow conditions.
Figure 5:
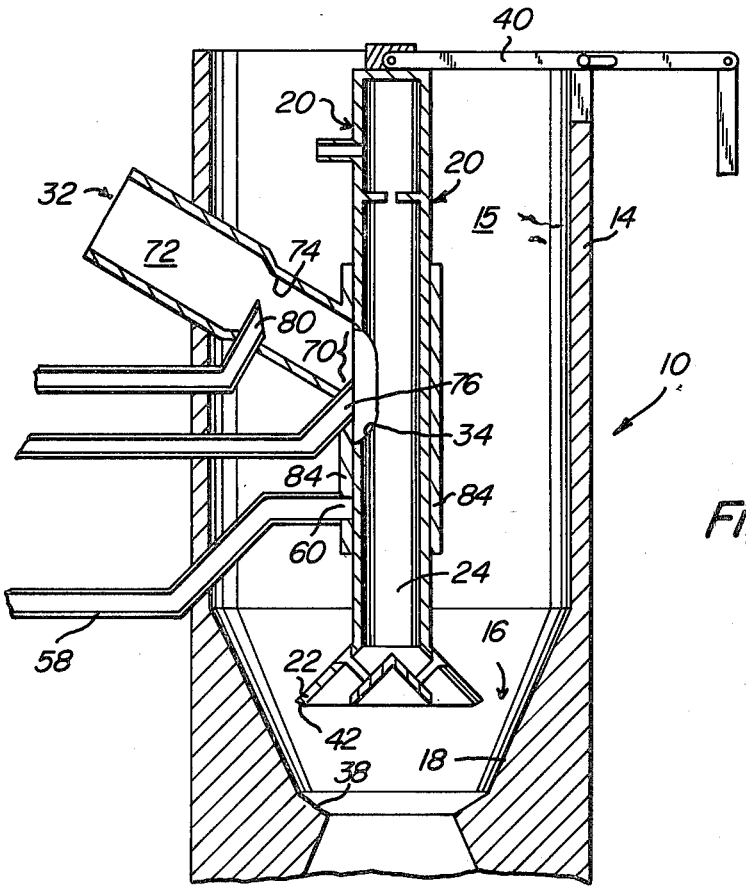
FIG. 5 is a view similar to FIG. 1 with certain elements removed for clarity which illustrates operation of the apparatus under maximum flow conditions.

A preferred embodiment of a variable venturi throttle apparatus 10 for mixing or dispersing a primary fuel and air mixture into an airstream to achieve a final and desired fuel and air mixture is illustrated in FIG. 1. The final fuel-air mixture is supplied to an intake manifold 12 of an internal combustion engine by connecting the apparatus 10 to the manifold 12, for example. A main body member 14 of the apparatus 10 defines a substantially hollow interior portion 15 which includes a main venturi 16 formed by a constricted throat portion 18 of the main body 14. To control the quantity of airflow through the main venturi 16, a throttle tube member 20 which has a fuel dispersing end 22 is positioned for longitudinal movement within the hollow interior portion 15. With the fuel dispersing end 22 seated or sealed against the constricted portion 18, no air flows through the venturi 16, and an idle fuel-air mixture is supplied to a hollow interior middle portion 24 of the throttle tube 20. The idle fuel-air mixture is suctioned from the throttle tube interior 24 into an intake port 26 of the manifold 12 during engine operation. The idle fuel-air mixture is supplied by a conventional idle mixture supply 28 through a primary intake opening 34 of the throttle tube 20. With the throttle tube 20 moved moderately longitudinally as is shown in FIG. 4, the fuel dispersing end 22 is positioned in a spaced apart relation with the constricted portion 18 to allow a moderate flow of air uniformly around the fuel dispersing end 22 and through the main venturi 16. Moderate longitudinal movement of the throttle tube causes air to flow through a boost venturi 32 and create the primary fuel-air mixture therein as a result of the primary intake opening 34 communicating with or opening into the boost venturi 32. The primary fuel-air mixture is suctioned through the primary intake opening 34 into the throttle tube interior 24 and is dispersed essentially uniformly from the fuel dispersing end 22 into the air flowing through the venturi 16. The primary fuel-air mixture disperses evenly into the air flowing through the venturi 16 and creates a final fuel-air mixture of a desired fuel-air ratio. Moving the throttle tube 20 to its maximum longitudinal extent opens the space between the end 22 and the constricted portion 18 to its maximum extent, as is shown in FIG. 5, resulting in maximum airflow through through the venturi 16. A maximum quantity of primary fuel-air mixture is supplied through the primary intake opening 34 to the throttle tube interior for dispersement into the venturi airstream. By this arrangement, the quantity of primary fuel-air mixture is increased in predetermined relation to the quantity of air flowing through the venturi 16.

The main body member 14 and the venturi 16 formed thereby are better understood by referring to FIGS. 1 and 2. The hollow interior portion 15 is defined by a cylindrically shaped and axially extending upper interior portion 35 and the constricted portion 18. The constricted portion 18 may be frustroconically shaped and is generally sized and contoured to secure the most desirable airflow characteristics through the venturi 16 depending upon specific use of the apparatus 10. The constricted portion 18 tapers or converges inward to define a circular orifice 36 through the constricted portion which completes the definition of the venturi 16.

A portion of the constricted portion 18 annularly surrounding the orifice 36 defines a throttle valve face 38 with which the fuel dispersing end 22 of the throttle tube 20 seats or registers under minimum or limited flow conditions. A throttle linkage means 40 longitudinally and axially moves or positions the throttle tube 20 within the hollow interior portion 15 when operatively pivoted at a pin 41 extending from the main body member 14. Appropriate openings are formed in the main body member 14 to support and allow entry of various elements associated with the boost venturi 32 and the idle fuel and air supply 28.

Details of the throttle tube member 20 are best understood by reference to FIGS. 1, 2 and 3. The throttle tube 20 is of generally hollow and cylindrical construction, and both an inner surface **22*a*** and an outer surface 22*b* (FIG. 3) of the fuel dispersing end 22 thereof are of an outwardly divergent contoured or frustroconical configuration. The specific contour of the fuel dispersing end 22 is determined in relation to the contour of the constricted portion 18 and coacts with the constricted portion 18 to provide an essentially uniformly distributed airflow around the end 22 and through the venturi 16. The outermost periphery of the fuel dispersing end 22 defines a circular shaped edge or throttle valve face 42 which registers or seats against the throttle valve seat 38 of the constricted portion 18 when the throttle tube 20 is positioned to seal the venturi 16 (shown in FIG. 1). To aid in evenly distributing the primary fuel-air mixture into the airstream flowing through the venturi 16, a distributing cone or vane 44 is positioned by supporting means 46 within the hollow interior portion of the end 22. The distributing vane 44 is a frustroconical configuration to distribute the primary fuel-air mixture outwardly and substantially circumjacently about the fuel dispersing end 22 into the airstream flowing between the throttle valve face 42 and the throttle valve seat 38.

The end of the throttle tube 20 opposite the fuel dispersing end 22 is essentially sealed by an end portion or end wall 48, to which the throttle linkage 40 is operatively connected. A vacuum chamber 50 is defined in the interior of the throttle tube by a baffle 52 positioned intermediate the end wall 48 and the primary mixture opening 34. A small opening 54 through the baffle causes the vacuum in chamber 50 to be essentially the same as the vacuum present in the throttle tube hollow interior 24. A nozzle 56 opens into the vacuum chamber 50, and a flexible hose (not shown) can be connected to the nozzle 56 for communicating vacuum to conventional engine control devices or to other devices used for other purposes, as is known in the art.

The idle mixture supply 28 supplies the idle fuel and air mixture to the hollow interior 24 of the throttle tube 20 through a rigid tubing 58 terminating at idle mixture delivery port 60. The supply of idle mixture is maintained only so long as the idle mixture delivery port 60 is in communication with the primary intake opening 34 of the throttle tube 20, and this condition exists when the fuel dispersing end 22 is seated against the constricted portion 18 in a closed position, as is shown in FIG. 1. The idle mixture supply is reduced as the edge of the throttle tube 20 around the primary intake opening 34 blocks the idle mixture delivery port 60, when the throttle tube 20 is longitudinally moved to an open position to create a space between the fuel dispersing end 22 and constricted portion 18 (FIG. 4). Under these moderate or low airflow conditions, only a slight amount of idle mixture is conducted through the idle mixture delivery port 60 since a relatively low quantity of primary fuel-air mixture is simultaneously supplied through opening 34 from the boost venturi 32. The idle mixture supply is terminated when such movement positions the idle mixture delivery port 60 in nonaligned or noncommunicative relationship with the primary intake opening 34 (FIG. 5). Thus the port 60 and opening 34 form an idle mixture valving means for the idle mixture supply.

With longitudinal movement of the throttle tube, the primary intake opening 34 opens into communicative relationship with a primary mixture delivery port 70 of the boost venturi 32, as is shown in FIGS. 4 and 5. The primary fuel-air mixture from the boost venturi 32 is suctioned through the port 70 and opening 34 into the throttle tube interior 24, where it is then dispersed from the fuel dispersing end 22. Referring also to FIG. 1, the boost venturi 32 is generally of cylindrically shaped construction having a hollow interior portion 72, and the boost venturi is rigidly attached to the main body member 14. The boost venturi 32 includes a constricted throat portion 74 opening into the primary mixture delivery port 70. A main fuel discharge port 76 is positioned adjacent the mixture delivery port 70 for supplying fuel from a main fuel supply 78 into the air flowing through the boost venturi. In addition, a supplementary fuel discharge port 80 is positioned within the hollow interior 72 to supply fuel from the main fuel supply 78 into the air flowing through the boost venturi under high flow rate conditions. By positioning the main fuel discharge port 76 adjacent the primary delivery port 70, low and moderate flow rates of air through the boost venturi 32 create a low pressure area around the main fuel discharge port 76 for drawing fuel therefrom. The fuel from the main port 76 mixes with the air and creates the primary fuel-air mixture under low or moderate flow rate conditions. Under high or maximum flow rate conditions the supplementary fuel discharge port 80 also adds fuel to the air flowing through the boost venturi, due to the low pressure created in the constricted portion 74 of the boost venturi. Thus, the primary mixture delivery port 70 and the primary intake opening 34 form a valving means for the primary mixture flow, and the main fuel discharge port 76 and supplementary fuel discharge port 80 assure that the supply of fuel increases as the flow of air through the boost venturi 32 increases. As is typical in the art, the fuel and air mixture exiting the venturi 32 is a flowstream of atomized fuel disbursed by operation of the venturi into a moving airstream. As is also typical, this flowstream mixture includes considerably more air than fuel and is itself preferably a combustible mixture. For gasoline the recognized range of combustible mixtures is from 8:1 to 20:1, air to fuel, by weight.

A sleeve or positioning member 84 is connected rigidly to the inner end of the boost venturi 32. The sleeve member 84 receives the throttle tube in a center opening 84*a* and retains the throttle tube 20 for longitudinal movement in the hollow interior portion 15 of the main body member 14. Operation of the throttle linkage 40 moves the throttle tube 20 longitudinally through the sleeve member 84 and positions the fuel dispersing end 22 in a seated or sealed relationship with the constricted portion 18 or in a plurality of selected spaced apart relationships with respect to the constricted portion 18. The throttle tube 20 is maintained in desired alignment with respect to the sleeve member 84 during longitudinal movement by conventional guiding means (not shown). The primary mixture delivery port 70 and the idle mixture delivery port 60 open into and communicate with the primary intake opening 54 through the sleeve member 84.

OPERATION

As is shown in FIG. 1, the flow of air through the hollow interior 15 is terminated when the fuel dispersing end 22 is sealed against the constricted portion 18 as a result of the throttle valve face 42 seating against the throttle valve seat 38 as has previously been described. Under these conditions only an idle mixture is supplied. The supply of idle mixture enters the interior 24 of throttle tube 20 through the idle mixture delivery port 60 and is dispersed from the fuel dispersing end 22 into the manifold entry port 26.

Under low or moderate flow conditions illustrated in FIG. 4, the throttle tube 20 is longitudinally moved and the fuel dispersing end is positioned in a moderately spaced relationship from the constricted portion 18, thereby allowing a generally uniform and undistorted moderate airflow around the fuel dispersing end 22 and through the orifice 36. The primary intake opening 34 is opened to the primary delivery port 70 of the boost venturi 32, and the resulting moderate airflow through the boost venturi 32 draws fuel from the main discharge port 76. The resulting moderate quantity of primary fuel-air mixture is uniformly dispersed by the distributing vane 44 around the periphery of the end 22 into the air flowing through the venturi 16. A minimum quantity of idle mixture is also conducted to the interior of the throttle tube since the idle mixture delivery port 60 minimally communicates with the primary mixture opening 34.

Under high or maximum airflow conditions as illustrated in FIG. 5, the throttle tube 20 is longitudinally moved to maximumly space the fuel dispersing end 22 from the constricted portion 18. The maximum longitudinal movement of the throttle tube 20 positions the primary intake opening 34 to maximally open the primary delivery port 70 of the boost venturi 32. The resulting maximum airflow through the boost venturi draws fuel from the main discharge port 76 and the supplementary fuel discharge port 80 to supply a maximum quantity of primary fuel-air mixture to the interior of the throttle tube 20. The primary fuel air mixture is dispersed uniformly and evenly into the undistorted airflow between the end 22 and constricted portion 18 in the venturi 16.

By mixing the primary fuel-air mixture with an airflow through the main venturi 16, a more complete and uniform atomization of the fuel and air in the final fuel-air mixture is obtained. The generally uniform flow of air through the venturi and flow of the primary fuel-air mixture dispersed create a generally uniform mixing action which is not subject to radial changes in pressure and flow direction, such as those resulting from a butterfly valve in a conventional carburetor. This arrangement secures a more precise and better control over the desired final fuel-air mixture. The apparatus 10 functions to supply the desired fuel-air ratio under a wide variety of operating conditions, thereby eliminating the changes in fuel-air mixture created by the butterfly valve and accelerator pump in conventional carburetors. The better fuel-air mixture results in more economy of fuel consumption and a reduction in the pollutant emissions from an internal combustion engine.

Due to the sliding valve arrangement of the primary intake opening 34 with respect to the the idle mixture delivery port 60, the supply of idle mixture is terminated under relatively moderate and increased flow rate conditions. Terminating the idle mixture supply eliminates any alteration of the final fuel-air mixture at increased flow rates due to a continuous supply of idle mixture, a situation which is not typical in conventional carburetors. Terminating the idle mixture supply obtains beneficial results in fuel consumption economy and pollutant emissions.

By terminating the primary fuel-air mixture supply during relatively low flow rate conditions, only the idle fuel-air mixture is drawn into the engine. The idle mixture and ratio are accurately regulated to obtain good combustion characteristics. Terminating the primary fuel-air supply eliminates or avoids the problem in conventional carburetors of drawing the condensed pockets of atomized fuel into the engine under high vacuum conditions. Consequently, the high hydrocarbon emissions resulting from partial combustion of large fuel droplets created under high speed—high vacuum conditions are significantly reduced. In addition, the present invention obtains many other desirable advantages and features over a conventional carburetor.

Although the present invention has been described with a certain degree of particularity, it should be understood that this disclosure has been made by way of preferred example, and that changes in details of structure may be made without departing from the spirit of the invention as expressed in the appended claims.

I claim as my invention:

1. Apparatus for mixing fuel in an airflow and supplying the fuel and air mixture in an intake opening of an engine, comprising:

a main body member defining a substantially hollow cylindrical and axially extending interior portion and a frustroconically-shaped constricted portion converging inwardly from the cylindrical interior portion, the constricted portion terminating inwardly at a circular-shaped orifice, the orifice directly communicating with the intake opening of the engine;

an elongated throttle tube member defining a middle portion with a substantially hollow interior, a first end portion closing the hollow interior at one end of the middle portion, and a second fuel dispensing hollow end portion opening from the other end of the hollow interior of the middle portion, the second end portion having an outer frustroconically-shaped surface diverging outwardly from the middle portion, the hollow interior of the second end portion being defined by an inner frustroconically-shaped surface diverging outwardly from the hollow interior of the middle portion, the outward divergence of the frustroconically-shaped inner and outer surfaces terminating at a circular edge, the circular edge being of diameter at least equal to the diameter of the orifice, the middle portion further defining a primary intake opening formed therein and communicating with the hollow interior of the middle portion;

a positioning member attached to said main body member and having a center opening formed therein in axial alignment with the orifice of said main body member, the center opening adapted to receive the middle portion of said throttle tube member and to allow axial movement of said throttle tube member within the center opening;

the middle portion of said throttle tube member being received within the center opening of the positioning member with the second end portion of the throttle tube member generally within the constricted portion of the main body member and with the hollow interior of the second end portion opening into the orifice;

means for axially moving said throttle tube member from a closed position in which the circular edge of the second end portion substantially closes the orifice of the main body portion to an open position in which the circular edge is axially spaced from the orifice and transversely spaced from the constricted portion of said main body member;

a primary delivery port defined in said positioning member at a predetermined location to communicate with the primary intake opening of said throttle tube member upon movement of said throttle tube member to a predetermined open position, the predetermined location also substantially preventing communication of the primary delivery port with the primary intake opening upon movement of said throttle tube member to the closed position;

boost venturi means for operatively mixing fuel with air to form a primary fuel and air mixture, said boost venturi means operatively connected for supplying the primary fuel and air mixture directly to the primary delivery port; and said primary intake opening being of predetermined configuration to expose increasing cross sectional amounts of the primary delivery port to the hollow interior middle portion in predetermined relation with increasing axial movement of said throttle tube member from the closed position toward the open position.

2. Apparatus as recited in claim 1 wherein said boost venturi means is positioned relative to said main body member for obtaining air for the primary mixture independently of the air flowing through the cylindrical interior portion of said main body member.

3. Apparatus as recited in claim 1 wherein said positioning means comprises a hollow sleeve member, said sleeve member defining the primary delivery port formed in a side thereof; and said boost venturi means further comprising a cylindrically-shaped tubular member having a hollow interior portion and a constricted throat portion, the constricted throat portion extending directly to the primary delivery port, and further comprising a fuel discharge port positioned within the constricted throat portion.

4. Apparatus as recited in claim 1 wherein the primary fuel and air mixture supplied to said primary delivery port is of a fuel-air ratio of which there is considerably more fuel than air, and said primiary mixture is disbursed from the hollow frustroconically-shaped second end portion of said throttle tube member into an airstream at the constricted portion of said main body member flowing into said orifice.

5. Apparatus as recited in claim 1 wherein the primary fuel and air mixture is a flowstream of atomized fuel disbursed within a moving airstream, and wherein the flowstream includes considerably more air than fuel.

6. Apparatus as recited in claim 1 further comprising:

means adapted for supplying an idle fuel and air mixture to the hollow interior of the middle portion of said throttle tube member upon movement of said throttle tube member to the closed position.

7. Apparatus as recited in claim 6 further comprising:

idle mixture valve means, operatively connected between the idle mixture supplying means and the hollow interior of the middle portion of said throttle tube member, for operatively supplying the idle mixture to the hollow interior upon movement of said throttle tube member to the closed position and for operatively terminating the supply of idle mixture upon a predetermined amount of movement of said throttle tube member into an open position.

8. Apparatus as recited in claim 7 further comprising:

an idle mixture delivery port defined in said positioning member at a predetermined location to communicate with the primary intake opening of said throttle tube member upon movement of said throttle tube member to the closed position, the predetermined location further terminating communication of said idle mixture delivery port with said primary intake opening upon movement of said throttle tube member to a predetermined open position, and means connecting said idle mixture delivery port to said idle mixture supplying means.

* * * * *